United States Patent [101]

Castonguay et al.

[11] 4,301,346

[45] Nov. 17, 1981

[54] CIRCUIT BREAKER TRIP LATCH ASSEMBLY

[75] Inventors: Roger N. Castonguay, Terryville; Charles L. Jencks, Avon, both of Conn.

[73] Assignee: General Electric Company, New York, N.Y.

[21] Appl. No.: 162,281

[22] Filed: Jun. 23, 1980

[51] Int. Cl.[3] ..... H01H 9/20; H01H 73/12

[52] U.S. Cl. ..... 200/320; 200/153 SC; 335/166

[58] Field of Search ..... 335/20, 166, 167, 168, 335/169, 170, 171, 172, 173, 174, 175, 26, 27, 28, 17; 200/320, 153 SC, 308, 153 G, 153 H

[56] References Cited

U.S. PATENT DOCUMENTS 4,121,077 10/1978 Mrenna et al. ..... 200/308

4,245,140 1/1981 Jencks et al. ..... 200/153 G 4,251,702 2/1981 Castonguay et al. ..... 200/153 SC

*Primary Examiner*—Harold Broome

*Attorney, Agent, or Firm*—Richard A. Menelly; Walter C. Bernkopf; Philip L. Schlamp

[57] ABSTRACT

A circuit breaker trip latch assembly includes a primary latch having a latching member releasably latching a cradle in its reset position against the bias of charged operating mechanism springs. The primary latch and either one of the first and second secondary latches commonly engage a latch pin carried by the free end of a pivotally mounted, elongated intermediate latch. The geometry of this common engagement is such as to greatly reduce the force of the charged mechanism springs ultimately absorbed by the first secondary latch as the cradle is relatched and the second, trip initiating, secondary latch while the breaker is closed.

10 Claims, 13 Drawing Figures

CIRCUIT BREAKER TRIP LATCH ASSEMBLY

REFERENCE TO RELATED APPLICATIONS

The instant application is related to the commonly assigned, concurrently filed patent applications entitled Flux Shifter Reset Assembly (Ser. No. 162,280), Undervoltage Release Reset and Lockout Apparatus (Ser. No. 162,271), Circuit Breaker Electrical Closure Control Apparatus (Ser. No. 162,278), Circuit Breaker Condition Indicator Apparatus (Ser. No. 162,282) and Circuit Breaker Hook Apparatus (Ser. No. 162,279).

The present invention relates generally to automatic electric circuit breakers and particularly to an improved circuit breaker trip latch assembly.

The subject latch assembly has particular, but not necessarily limited application to a stored energy, reclosure type circuit breaker, such as that disclosed in applicant's commonly assigned, copending application, Ser. No. 052,276, filed June 25, 1979 now Pat. No. 4,251,702. The disclosure of this copending application is specifically incorporated herein by reference. Stored energy, reclosure type circuit breakers have the capability of reclosing immediately after having been tripped open. However, as a prerequisite to reclosure, the breaker's cradle or trigger, which was released by a latch to spring from its reset position to its tripped position incident to tripping the breaker open, must be returned to its reset position where it is again sustained by the latch. As the interval between tripping open and reclosure of the circuit breaker is reduced, considerable demands are imposed on the trip latch. That is, the trip latch must be fast acting such that it can regain latching engagement with the cradle as it is rapidly restored to its reset position. The considerable impacting forces of the cradle with the latch must be contended with so the latch is not "shocked out", thus failing to sustain the cradle in its reset position. While taking into account the above considerations, the latch must accommodate a low tripping force within the capability of conventional tripping devices, such as flux-shifting trip solenoids, shunt trip solenoids, undervoltage release solenoids, etc.

It is accordingly an object of the present invention to provide an improved trip latch assembly for multi-pole industrial circuit breakers.

Another object is to provide a trip latch assembly of the above character which is capable of resetting itself in rapid fashion.

A further object is to provide a trip latch assembly which is capable of latchably capturing on the fly the cradle of an abruptly charged breaker operating mechanism.

An additional object is to provide a trip latch assembly of the above character which is capable of withstanding the impact forces incident to releasably relatching the cradle of an abruptly charged breaker operating mechanism.

Yet another object is to provide a trip latch assembly of the above character wherein the mechanical advantage gained by the utilization of a differential in moment arms affords a significant reduction in the force required to sustain the operating mechanism in its charged condition.

A still further object is to provide a trip latch assembly of the above character which accommodates a light trip initiating force to unlatch the cradle of a charged breaker operating mechanism.

Another object of the present invention is to provide a trip latch assembly of the above character which is efficient in construction, convenient to manufacture, and reliable in operation.

Other objects of the invention will in part be obvious and in part appear hereinafter.

SUMMARY OF THE INVENTION

In accordance with the present invention, there is provided an improved trip latch assembly for a multipole, industrial circuit breaker which is capable of rapid resetting, able to withstand the high impact forces incident with resetting of the circuit breaker operating mechanism from its tripped condition, and capable of absorbing the powerful force exerted by a charged operating mechanism while accommodating a light unlatching force to trip the circuit breaker. To these ends, the trip latch assembly includes a pivotally mounted primary latch equipped to, in turn, pivotally mount adjacent one end a primary latch member for releaseably latching the cradle of a charged circuit breaker movable contact operating mechanism in its reset position. An elongated intermediate latch is pivotally mounted adjacent one end and carries adjacent its other end an intermediate latch pin which is commonly engaged by the other end of the primary latch and either one of first and second secondary latches capable of withstanding the force exerted on the trip latch assembly by the charged operating mechanism. The geometry of this common engagement coupled with the elongation of the intermediate latch, is such that the charged operating mechanism force, as exerted on the secondary latches, is significantly attenuated.

The first secondary latch is pivotally mounted for movement between an unlatching position, assumed in response to closure of the breaker contacts, and a latching position, assumed in response to opening of the breaker contacts, to present a first prop for engagement by the latch pin. The latch pin engaging surface of this first prop is radiused about the pivotal mounting axis of the first secondary latch such that the impacting forces incident with abrupt resetting of the cradle to its latched, reset position, do not shock this secondary latch out of its latching position.

The second secondary latch is pivotally mounted for movement between a trip initiating, unlatching position and a latching position presenting a second prop in position to engage the latch pin when the first secondary latch is moved to its unlatching position in response to closure of the breaker contacts. The latch pin engaging surface of the second prop is configured such that the force on the second secondary latch creates a moment in the direction of its unlatching position which is overpowered by a return spring. Consequently, an exceptional light tripping force is all that is necessary to pivot the second secondary latch to its unlatching position to precipitate tripping of the breaker.

As the breaker contacts spring open, the first secondary latch is restored to its latching position, thereby regaining latching control over the intermediate latch pin and thus resetting the trip latch assembly well before the cradle can be returned to its reset position to charge the operating mechanism. The exceptionally low mass of the primary latch member renders it capable of swift pivotal movement, thus to insure its latching capture of the cradle in its reset position at the conclusion of abrupt charging of the breaker operating mechanism.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
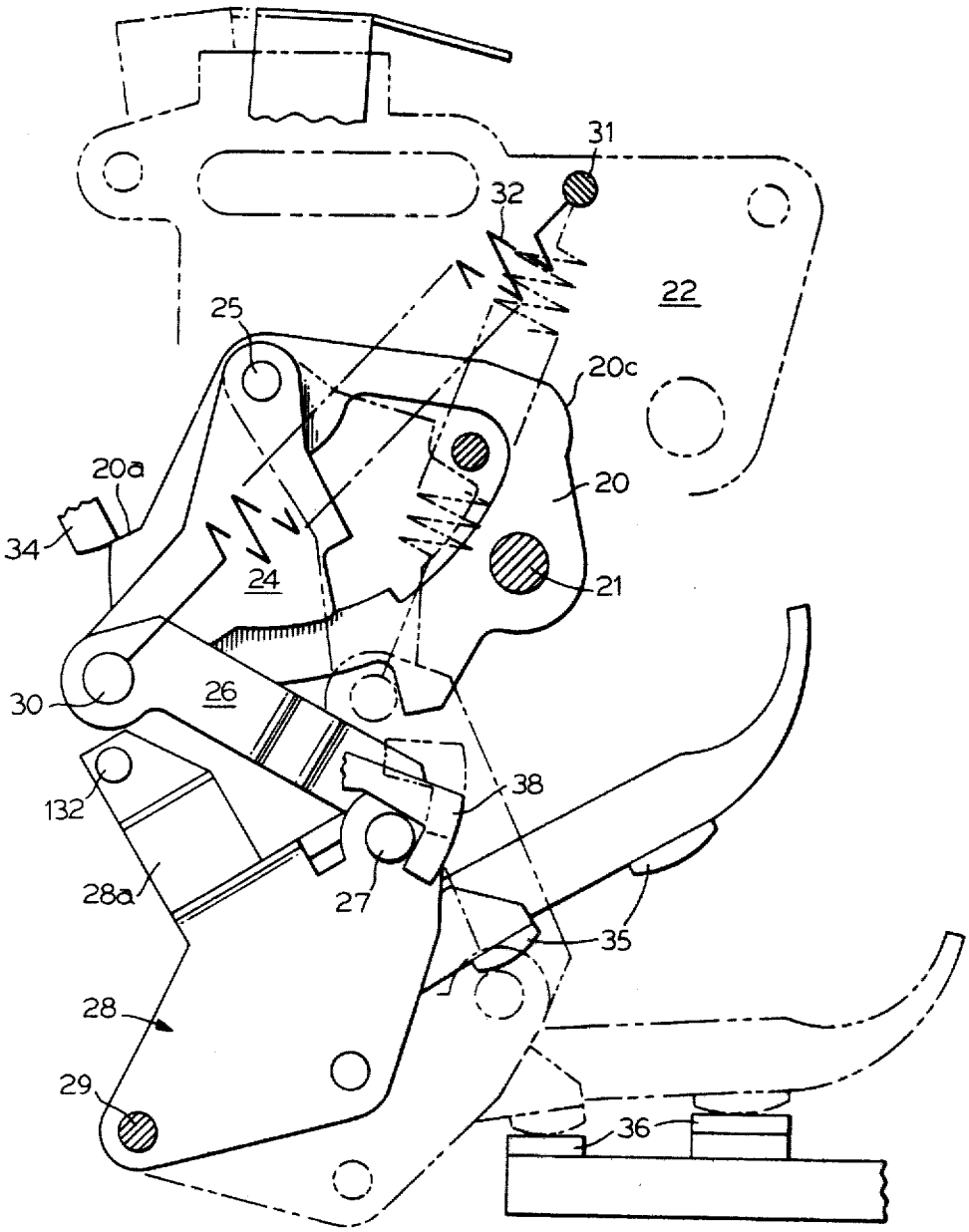
FIG. 1 is a side elevational view of a circuit breaker spring-powered movable contact operating mechanism.

Turning to the drawings, there is shown in FIG. 1, a circuit breaker movable contact operating mechanism corresponding to that disclosed in the abovenoted copending application, Ser. No. 052,276. Thus, a cradle 20 is fixedly mounted on a pin 21 journalled by opposed mechanism frame sideplates 22. A toggle linkage consisting of an upper link 24 and a lower link 26 connects cradle 20 to a center pole movable contact assembly 28, pivotally mounted at 29. Specifically, the upper end of link 24 is pivotally connected to the cradle by a pin 25, while the lower end of link 26 is pivotally connected to the center pole movable contact assembly by a pin 27. The other ends of these toggle links are pivotally interconnected by a knee pin 30. Mechanism tension springs 32 act between the toggle knee pin and a stationary pin 31 supported between the frame sideplates 22.

From the description thus far, it will be noted that, by virtue of the position of spring anchoring pin 31, the line of action of the mechanism springs, while in their charged state by virtue of cradle 20 being in its latched reset position sustained by the engagement of a latch 34 with cradle latch shoulder **20*a*, is always situated to the right of the upper toggle link pivot pin 25. Thus, the mechanism springs continuously act to straighten the toggle. Since straightening of the toggle forces the movable contact assemblies 28, ganged together by crossbar 28*a*, to pivot downwardly to their phantom line, closed circuit position with their movable contacts 35 engaging stationary contacts 36, the circuit breaker is always biased toward contact closure while cradle 20** is latched in its reset position.

To control the moment of contact closure, a hook 38 engages pin 27 to hold movable contact assemblies 28 in a hooked open circuit position while the cradle is latched in its reset position and while it is being returned to its latched, reset position from a clockwise-most tripped position to charge the mechanism springs. Thus the toggle is maintained collapsed to the left as seen in FIG. 1. When the hook is removed, the movable contact assemblies 28 are pivoted to their closed circuit positions as springs 32 act to abruptly straighten toggle links 24, 26.

Figure 2:
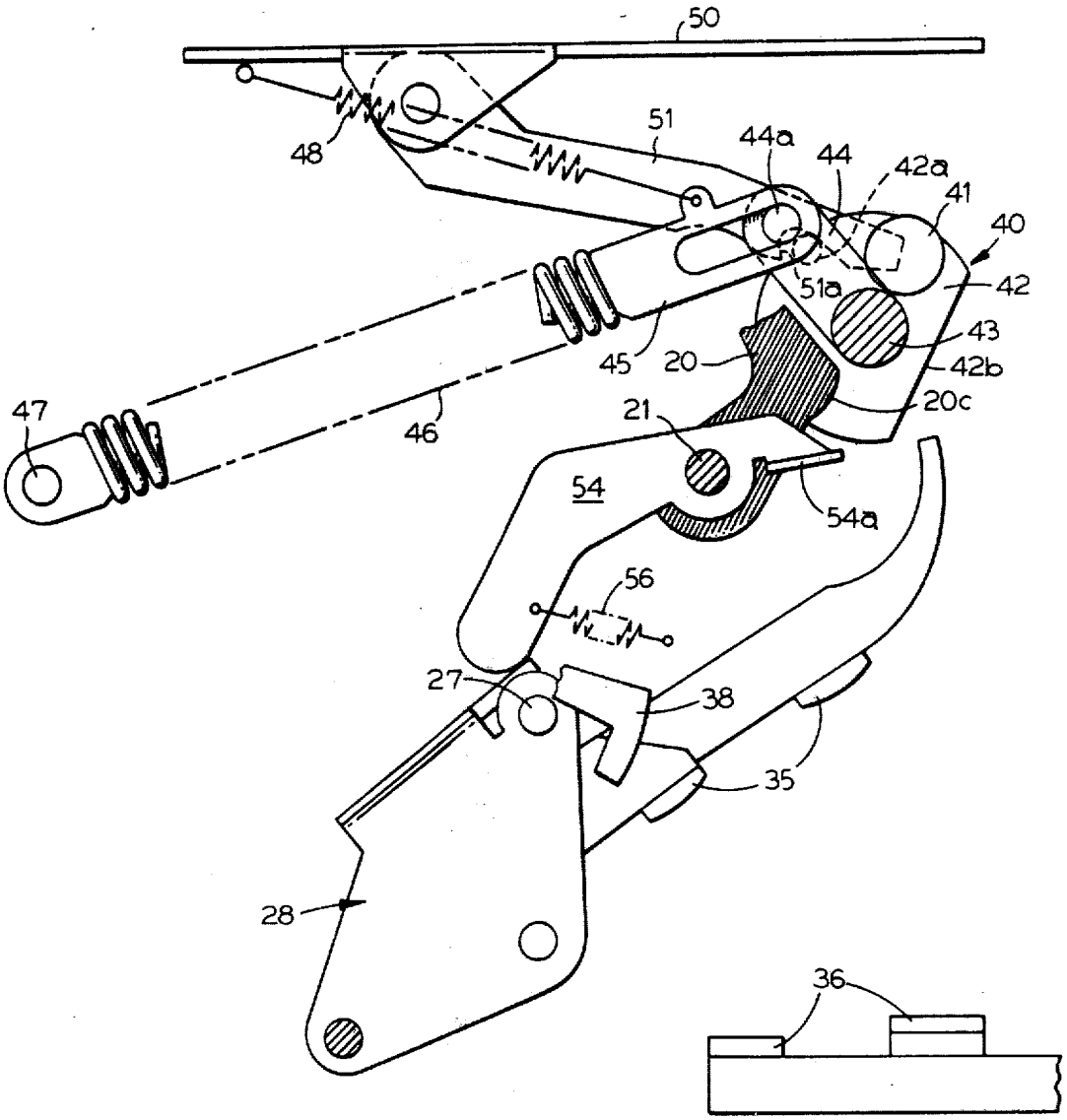
FIG. 2 is a simplified, side elevational view of a spring-powered charging mechanism utilized to charge the movable contact operating mechanism of FIG. 1.
Figure 3:
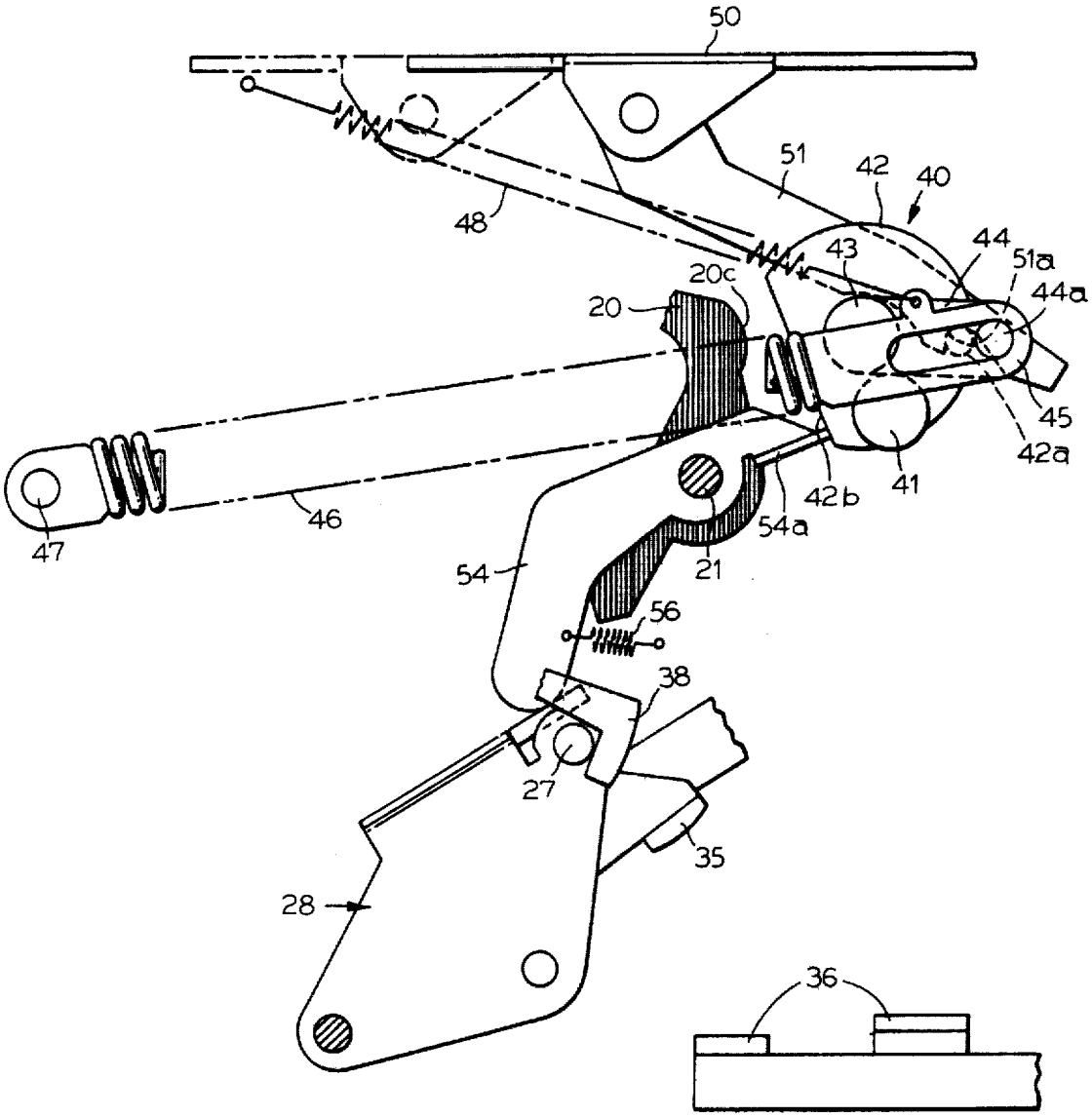
FIG. 3 is a simplified, side elevational view of the charging mechanism of FIG. 2 in its condition with a charge stored therein and while a charge is stored in the movable contact operating mechanism.
Figure 4:
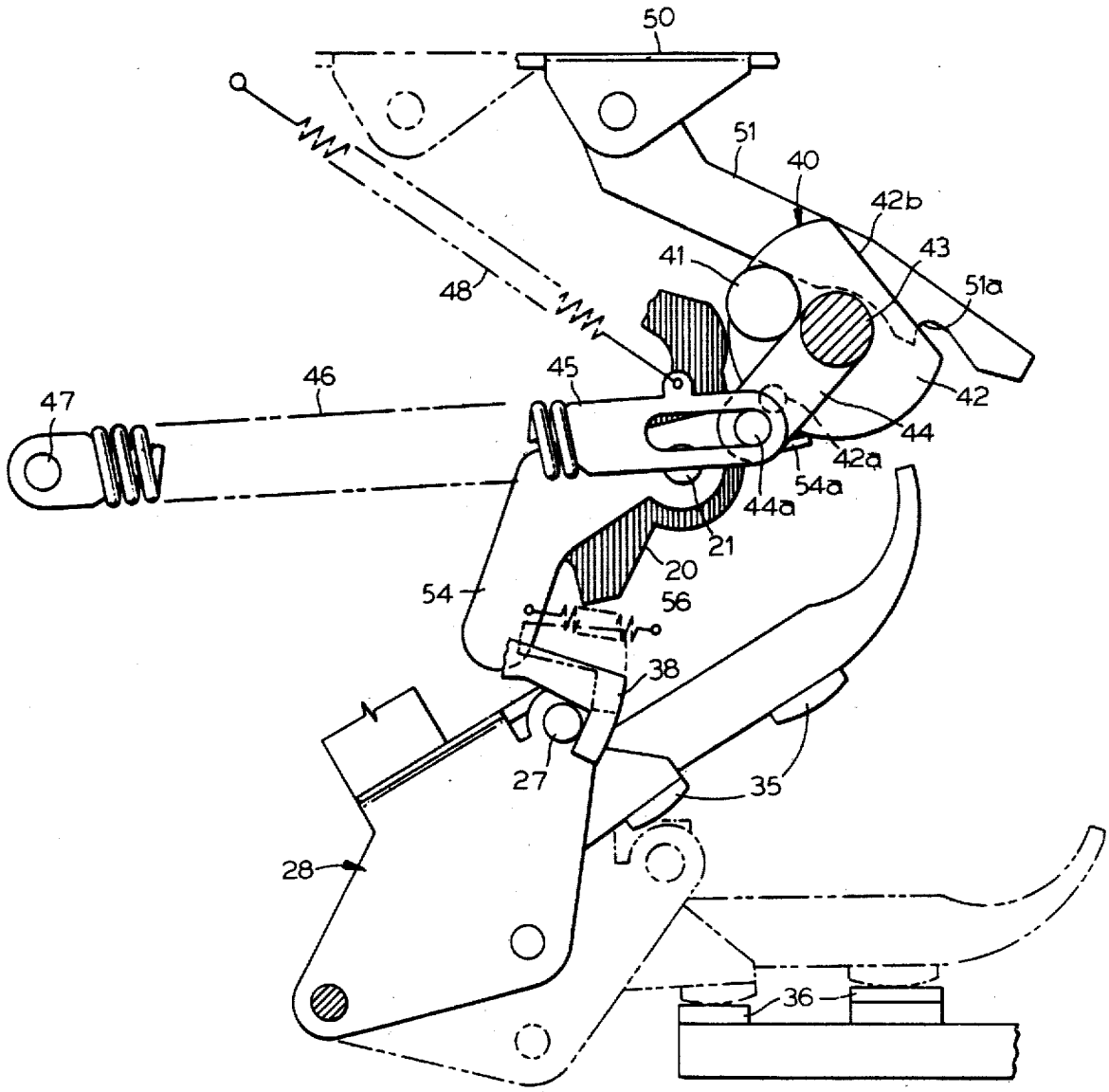
FIG. 4 is a simplified, side elevational view of the charging mechanism seen in its discharged condition while a charge is stored in the movable contact operating mechanism.

Reference is now had to FIGS. 2 through 4 for a review of the overall operation of the circuit breaker disclosed in the above-noted application, Ser. No. 052,276, and specifically the operation of a separate charging mechanism in charging the mechanism springs of the movable contact operating mechanism of FIG. 1. To induce counter-clockwise resetting pivotal movement of cradle 20, a bell crank assembly, generally indicated at 40, is provided with a reset roller 41 eccentrically mounted by a bell crank arm 42 carried by a shaft 43 journalled by the frame sideplates. Keyed to this shaft is an arm 44 which carries at its free end a pin **44*a* operating in an elongated slot in a spring anchor 45 secured to one end of a powerful tension spring 46. The other end of this spring is anchored to a stationary pin 47. As will be seen, when charging spring 46 discharges, bell crank assembly 40 is rotated clockwise to swing the reset roller around to engage a nose 20*c* of cradle 20, while in its tripped position, thereby driving the cradle in the counterclockwise direction to its latched reset position, in the process charging the contact operating mechanism springs 32 (FIG. 1**).

Referring first to FIG. 2, bell crank assembly 40 is seen in its start angular orientation achieved by the action of a tension spring 48. An operator slide 50 is shown in its left-most return position with a pawl 51, pivotally connected thereto, retracted to a position where a notch **51*a* in its free end is in intercepting relation with an eccentric pin 42*a* carried by crank arm 42. From FIG. 3 it is seen that when slide 50 is propelled to the right through a breaker operating mechanism charging stroke, drive pawl 51 is pushed to the right. Its notch 51*a* picks up pin 42*a*, causing bell crank assembly 40** to be rotated in the clockwise direction. When the bell crank assembly reaches its angular position of FIG.

3, it is seen that charging spring 46 is stretched to a charged state. It is assumed, at this point in the description, that the movable contact operating mechanism of FIG. 1 is tripped, and thus cradle 20 is in its clockwise-most tripped position seen in FIG. 2. Under these circumstances, the essentially discharged contact operating mechanism springs 32 have lifted movable contact assemblies 28, to a counterclockwise-most tripped open position also seen in FIG. 2. In this position, the top surface of the center pole movable contact assembly engages and lifts the left lower end of a prop 54 pivotally mounted intermediate its ends by cradle pin 21. The upper end 54*a* of this prop is moved downwardly out of engaging relation with the arcuate surface portion of the bell crank arm against which it is normally engaged under the bias of a return spring 56.

As seen in FIG. 3, the rightward charging stroke of operator slide 50 is sufficient to carry the line of action of charging spring 46 through the axis of the bell crank assembly shaft 43. Consequently, with prop 54 in its FIG. 2 position, the charging spring immediately discharges and the bell crank assembly is thereby driven in the clockwise direction, swinging reset roller 41 into engagement with nose 20*c* of cradle 20 in its tripped position of FIG. 2. The cradle is thus swung in the counterclockwise direction to its reset position as the discharging springs 46 drive the bell crank assembly to its angular position seen in FIG. 4. As cradle 20 is being reset, contact operating mechanism springs 32 are charged to exert a bias tending to drive the movable contact assemblies 28 to their closed circuit positions seen in phantom in FIGS. 1 and 4. However, hook 38 is in position to intercept pin 27 and detain the movable contact assemblies in their hooked open position seen in FIGS. 3 and 4. By virtue of the loss motion coupling between bell crank assembly 40 and charging spring 46 afforded by the slot in spring anchor 45, spring 48 acts to continue the clockwise rotation of the bell crank assembly from its angular position of FIG. 4 around to its start position of FIG. 2 with pin 44*a* again bottomed against the right end of the spring anchor slot.

From the description thus far, it is seen that the first charge-discharge cycle of charging spring 46 has been effective in returning the contact operating mechanism cradle 20 to its latched reset position and charge springs 32 thereof, but the breaker contacts are sustained in their hooked open position by hook 38. At this point, the operator slide 50 can be motivated through a second rightward charging stroke to again charge spring 46. Since movable contact assemblies 28, in their hooked open position, have released prop 54, its upper end 54*a* rides on the arcuate surface portion of bell crank arm 42 as the bell crank assembly is rotated in a clockwise direction. Spring 56 elevates prop end 54*a* into intercepting relation with a flattened surface 42*b* of bell crank arm 42 at the conclusion of the operator slide charging stroke just as the line of action of the charging spring 46 passes below the axis of bell crank assembly shaft 43. Thus, as seen in FIG. 3, prop 54 serves to prevent further clockwise rotation of bell crank assembly 40, and the charging spring 46 is held in a fully charged condition. It is thus seen that while the breaker contacts are held in their hooked open circuit position by hook 38, both the charging spring 46 and contact operating mechanism springs 32 are poised in their fully charged conditions. At this point, hook 38 may be articulated to release the movable contact assemblies 28, whereupon they pivot to their closed circuit position under the urgence of mechanism springs 22. It will be noted that closure of the movable contacts has no effect on prop 54, and thus charging spring 46 is sustained in its fully charged condition.

When the circuit breaker is eventually tripped open by removal of latch 34 (FIG. 1), the unlatched cradle 20 swings clockwise to its tripped position, and the movable contact assemblies abruptly pivot upwardly to their tripped open position of FIG. 2, all under the urgence of the discharging contact operating mechanism springs 32. As the center pole movable contact assembly moves to its tripped open position, it picks up the lower end of prop 54, ducking its upper end out of engagement with the flat peripheral surface 42*b* of crank arm 42. The clockwise rotational restraint on the bell crank assembly is thus removed, and charging spring 46 abruptly discharges, swinging reset roller 41 around to drive cradle 20 from its tripped position of FIG. 2 back to its reset position of FIG. 3. The contact operating mechanism springs 32 are again charged, and the movable contact assemblies 28 move to their hooked open position seen in FIG. 4. At this point, the charging spring 46 may again be charged to create the condition depicted in FIG. 3, and the charge therein will be automatically stored by prop 54 until needed to recharge the contact operating mechanism springs 32. Alternatively, and more significantly, hook 38 may be articulated to precipitate closure of the breaker, and thereafter the breaker may be tripped open without charging the charging spring 46.

From the foregoing description, it is seen that with the breaker contacts open and its contact operating mechanism tripped, the charging spring can be put through a first charge-discharge cycle to charge the contact operating mechanism springs 32 and then a second charge which is stored by prop 54 until needed to re-charge the mechanism springs. Thus, the circuit breaker, starting in its tripped open condition and with two chargings of charging spring 46, can be, in sequence, closed, tripped open, reclosed and tripped open again without an intervening charging of the charging spring. It follows from this that the charging spring can be charged with the breaker contacts closed to achieve, in sequence, opening, closing and opening operations of the circuit breaker without an intervening charge.

Figure 5:
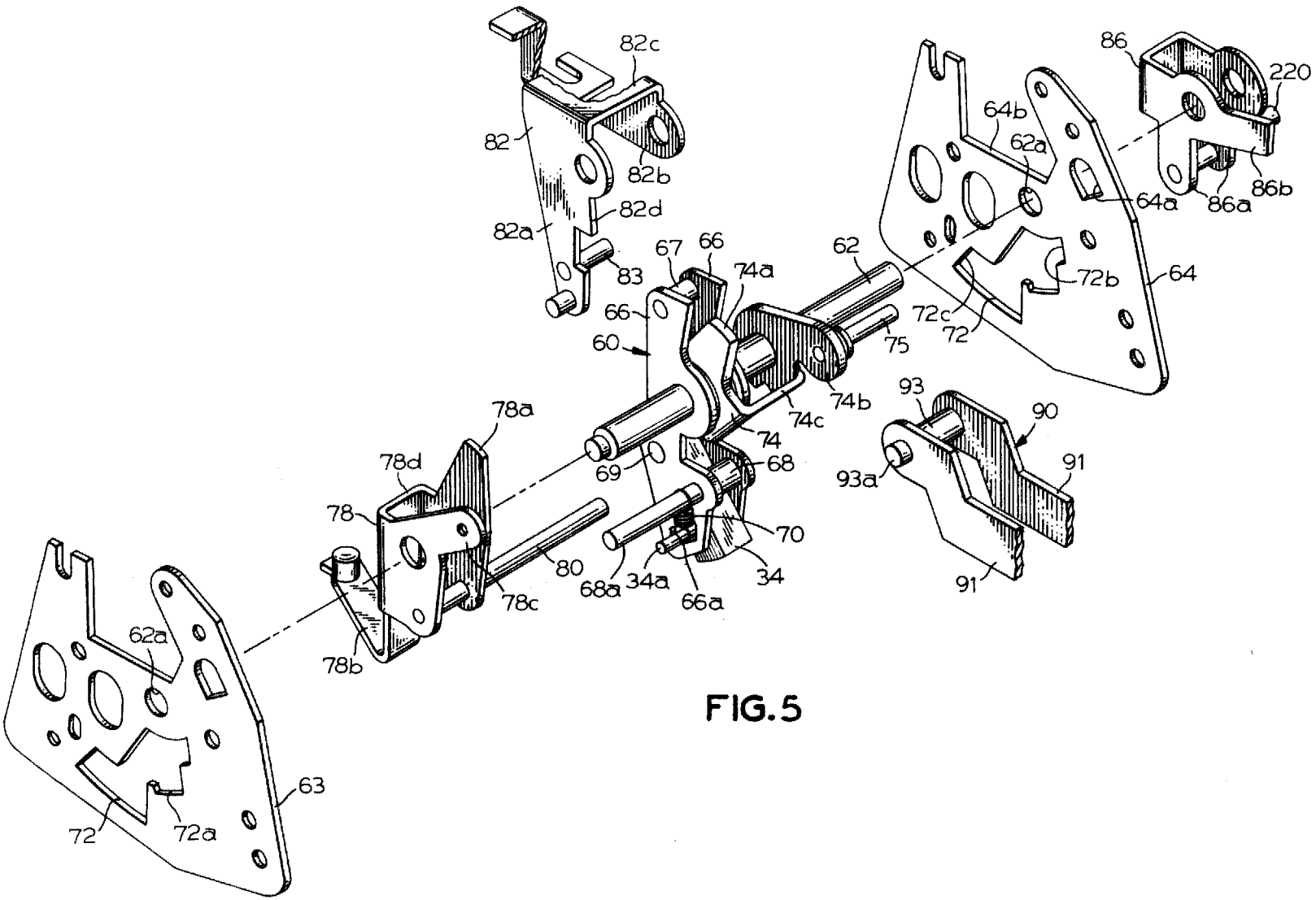
FIG. 5 is an exploded perspective view of a trip latch assembly utilized with the movable contact operating mechanism of FIG. 1 and the charging mechanism of FIG. 2.
Figure 11:
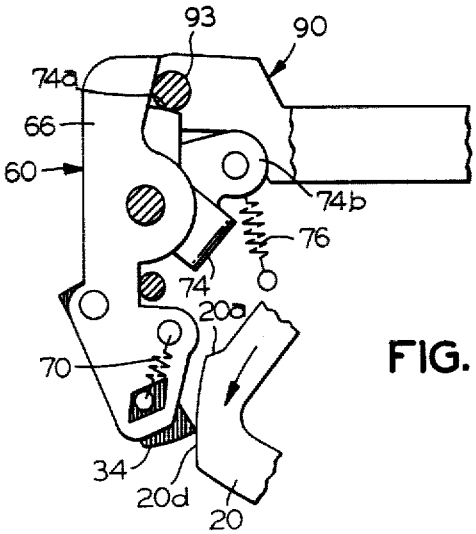
FIG. 11 is a side elevational view of the trip latch assembly of FIG. 5 seen in its reset condition and about to relatch the cradle on its return to a reset position.
Figure 12:
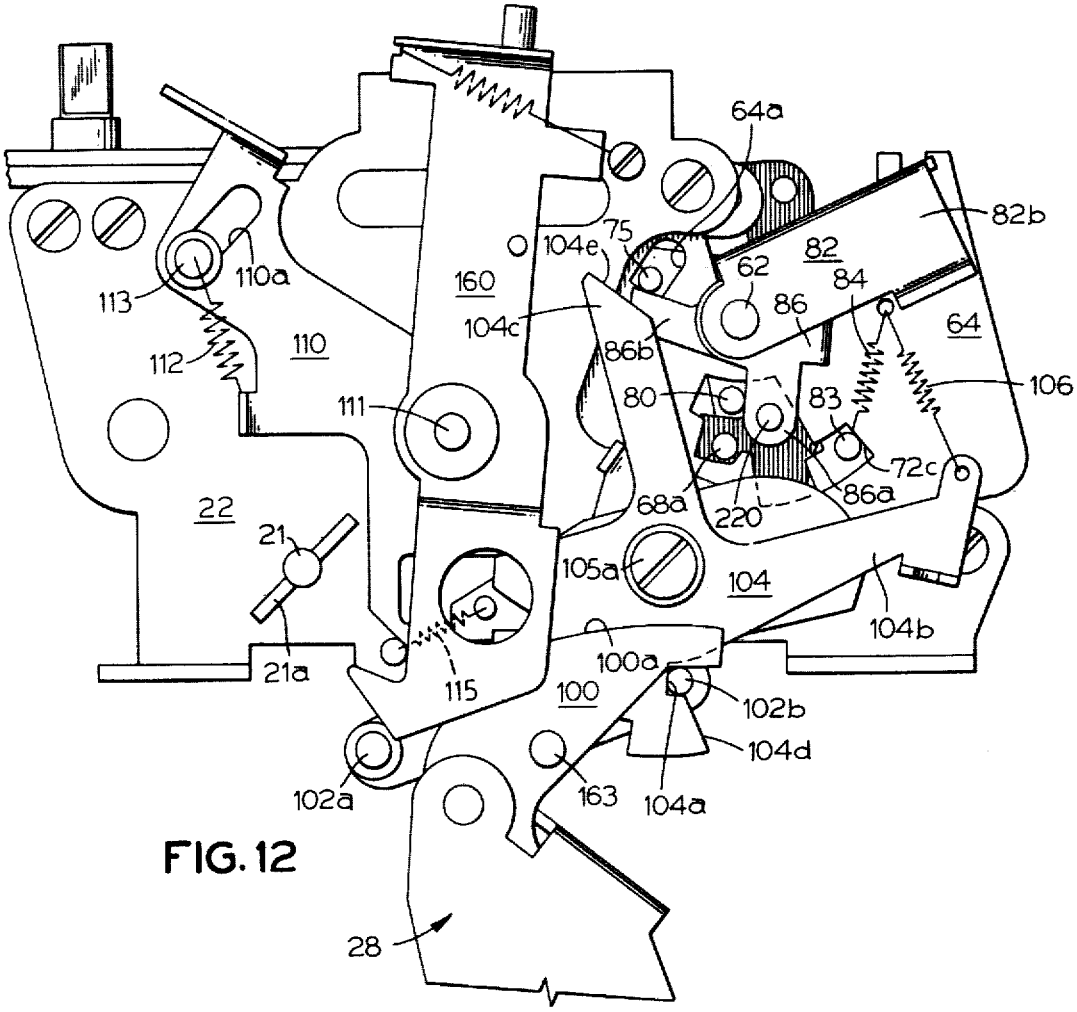
FIG. 12 is a side elevational view of an industrial circuit breaker showing releaseable hook apparatus for holding the breaker movable contacts in their hooked open position of FIG.. 3.

The trip latch assembly uniquely constructed to accommodate the abrupt resetting of cradle 20 incident with the discharge of charging spring 46 is seen in FIGS. 5 through 11. Referring first to FIG. 5, this trip latch assembly comprises a primary latch assembly, generally indicated at 60 and pivotally mounted by a shaft 62 supported in holes 62*a* provided in opposed sideplates 63 and 64, secured as extensions of the opposed mechanism frame sideplates 22, as seen in FIG. 12. The primary latch assembly includes a pair of arms 66 secured in spaced, parallel relation by pins 67 and 68. These arms mount a pin 69 serving to pivotally mount the upper end of the cradle latching, primary latch 34, also seen in FIG. 1. A pin 34*a*, carried by latch 34, projects transversely through an enlarged opening 66*a* in one of the arms 66 and is hooked by one end of a tension spring 70. The other end of this spring is hooked on an extension 68*a* of pin 68, such that primary latch 34 is biased in the counterclockwise direction about its pivot pin 69 to a cradle latching position with pin 34*a* abutting the right edge of arm opening 66*a*. Pin extension 68*a* projects transversely through a cutout 72 in sideplate 63 and swings in a notched portion 72*a* thereof which serves to define the limits of pivotal movement of primary latch assembly 60 about shaft 62.

Still referring to FIG. 5, also pivotally mounted by shaft 62 is a first secondary latch 74 consisting of an upstanding prop 74*a*, disposed intermediate arms 66 of primary latch assembly 60, and an actuating arm 74*b*, situated to the right of the primary latch subassembly. The prop and actuating arm are interconnected by an integral bight portion 74*c*. The free end of the actuating arm carries a pin 75 which projects transversely through an enlarged slot 64*a* in sideplate 64. A spring 76, seen in FIG. 6, biases the first secondary latch in the clockwise direction to bottom pin 75 against the lower straight edge of slot 64*a*.

Figure 8:
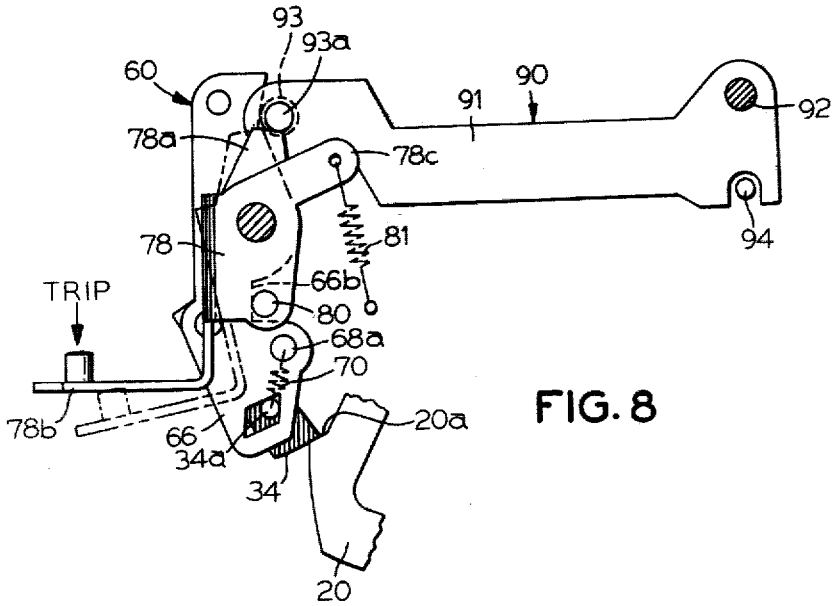
FIG. 8 is a side elevational view of the trip latch assembly of FIG. 5 seen in its cradle latching condition while the breaker contacts are closed.

Again returning to FIG. 5, a second secondary latch 78 is also pivotally mounted on shaft 62 and consists of an upstanding prop 78*a*, situated immediately to the left of primary latch assembly 60, an actuating arm 78*b*, and a spring return arm 78*c*, all joined together by an integral bight portion 78*d*. This secondary latch carries a pin 80 which projects transversely through cutout 72 in sideplate 64. As seen in FIG. 8, a spring 81, hooked to arm 78*c*, biases secondary latch 78 to its clockwise-most position with pin 80 engaging edge portions 66*b* of primary latch assembly arms 66. The limit of counterclockwise pivotal movement of this secondary latch is determined by the abutment of pin 80 with cutout edge portion 72*b* of sideplate 64.

Also pivotally mounted by shaft 62 is a secondary latch actuating lever or trip lever 82, seen in FIGS. 5 and 12. This trip lever includes a depending arm 82*a*, situated to the inboard side of sideplate 64, a horizontally extending arm 82*b*, situated to the outboard side of sideplate 64, and an interconnecting bight portion 82*c*, whose transverse extension is accommodated by a notch 64*b* formed in sideplate 64. A pin 83, carried by depending arm 82*a*, projects transversely through cutout 72 in sideplate 64, and, as seen in FIG. 12, anchors one end of a spring 84 serving to normally bias lever 82 in the counterclockwise direction (clockwise in FIG. 5) to abut pin 83 against cutout edge portion 72*c*.

A U-shaped secondary latch defeat lever 86 is also pivotally mounted by shaft 62 in nested relation with trip lever 82 to the outboard side of sideplate 64, as seen in FIGS. 5 and 12. This lever includes a pair of depending legs 86*a* positioned in intercepting relation with pin 80 carried by second secondary latch 78 and projecting through cutout 72 in sideplate 64 and a horizontally extending arm 86*b* positioned in intercepting relation with pin 75 carried by the first secondary latch 74 and projecting through the same sideplate cutout. Thus, as will be seen, when secondary latch defeat lever 86 is pivoted in the clockwise direction seen in FIG. 12, these pins are picked up, and secondary latches 74 and 78 are thus pivoted in the clockwise direction to latch defeat positions rendering primary latch assembly 60 incapable of sustaining cradle 20 (FIG. 1) in its reset position.

Completing the description of the trip latch assembly, there is provided an intermediate latch, generally indicated at 90, and consisting of a pair of elongated parallel spaced levers 91 pivotally mounted at their corresponding one ends by a pin 92 (FIGS. 6 and 8 through 10) supported between mechanism frame sideplates 22. As best seen in FIG. 5, a latch pin 93 is mounted by the free ends of levers 91. As seen in FIGS. 6 and 8 through 10, a stationary pin 94 is received in notches 91*a* in levers 91 to limit the pivotal movement of intermediate latch 90.

Figure 6:
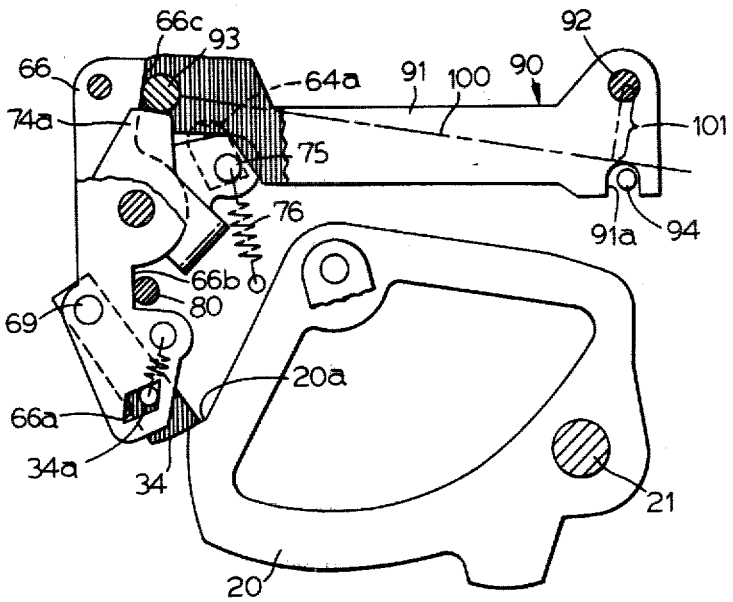
FIG. 6 is a side elevational view of the trip latch assembly of FIG. 5 seen in its cradle latching condition while the circuit breaker movable contacts are held in a hooked open position of FIG. 3.

The interaction of the various trip latch assembly parts in latching and unlatching cradle 20 pursuant to resetting and tripping the movable contact operating mechanism will now be described. FIG. 6 depicts the positions of the latch assembly parts while the cradle 20 is latched in its reset position by primary latch 34, and the movable contact assemblies 28 in their solid line, hooked open position seen in FIG. 1. As previously noted, the line of action of mechanism springs 32 is to the left of cradle pivot pin 21, and thus a clockwise moment is exerted on the cradle. By virtue of the engagement of primary latch 34 with the cradle, springs 32 also exert a clockwise moment on primary latch assembly 60 about its pivotal mounting shaft. This moment is resisted by intermediate latch 90 whose latch pin 93 engages sloping upper edge portions 66*c* of arms 66. The slope angle of these edge portions is such that the line of force, indicated at 100, exerted on intermediate latch 90 by the mechanism springs via the primary latch assembly lies below intermediate latch pivot pin 92. Thus a counterclockwise moment having a relatively short moment arm, indicated at 101, is exerted on the intermediate latch. Counterclockwise pivotal movement of the intermediate latch is resisted by the engagement of latch pin 93 with the upper arcuate edge of the first secondary latch prop 74*a*. Preferably, this arcuate edge is radiused about the axis of shaft 62, and thus the force exerted on the first secondary latch 74 exerts essentially zero moment thereon. By virtue of the elongation of intermediate latch 90, the relatively large force exerted on the intermediate latch by the primary latch assembly is translated into a relatively light force exerted on the secondary latch 74 by the intermediate latch. Thus, if the moment arm achieved by the elongation of the intermediate latch, i.e., the distance between pivot pin 92 and latch pin 93, is six times the length of moment arm 101, a sixfold force reduction is achieved.

Figure 7:
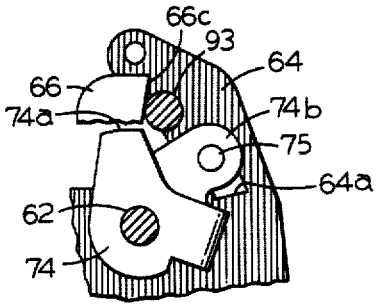
FIG. 7 is a fragmentary side elevational view of the trip latch assembly of FIG. 5 illustrating its response to closure of the breaker contacts.

As will be fully described below, when the movable contact assemblies are unhooked, and mechanism springs 32 act to straighten the toggle links, propelling the contact assemblies to their closed circuit position, secondary latch 74 is incidentally pivoted in the counterclockwise direction seen in FIG. 6. Its prop 74*a* is thus swung from a latching position engaging latch pin 93 (FIG. 6) to an unlatching position in disengaged relation with the latch pin (FIG. 7). The free end of intermediate latch 90 moves downward slightly, whereupon the reduced diameter portion 93*a* (FIG. 5) of the latch pin projecting beyond one of the intermediate latch levers 91 encounters prop 78*a* of secondary latch 78, as seen in FIG. 8. To accommodate this action, props 74*a* and 78*a* are of essentially the same height. The very slight increment of clockwise rotation of primary latch assembly 60 permitted by the transfer of control of the intermediate latch from secondary latch 74 to secondary latch 78 is insufficient to disengage latch 34 from cradle latch shoulder 20*a*. The upper edge of prop 78*a* is preferably radiused about a center located to the left of the axis of shaft 62, such that the force exerted by the intermediate latch creates a counterclockwise moment on secondary latch 78. This moment is slightly overpowered by spring 81 to maintain secondary latch in its clockwise most position determined by the abutment of pin 80 with edge portions 66*b* of arms 66.

Figure 9:
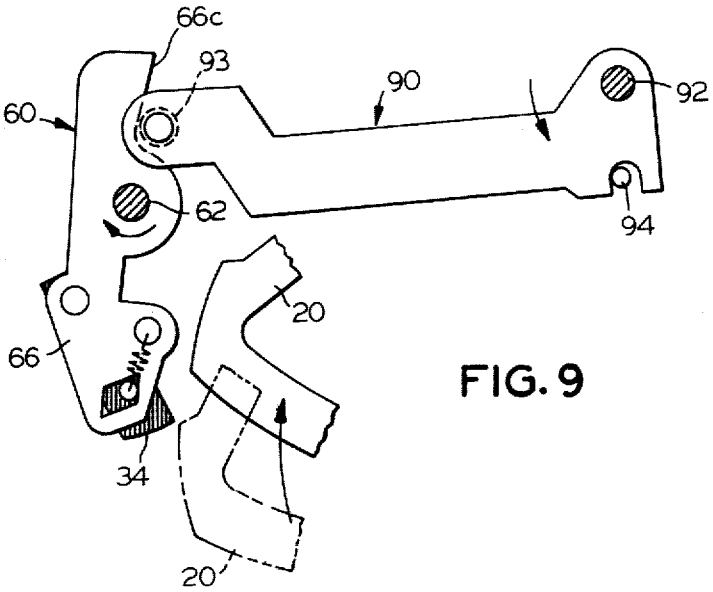
FIG. 9 is a fragmentary, side elevational view of the trip latch assembly of FIG. 5 seen in its tripped, cradle unlatching condition.

By virtue of this structural arrangement, a very low trip force exerted on arm 78*b* by, for example, a flux shifting trip solenoid, is accommodated to rotate secondary latch 78 in the counterclockwise direction from a latching position to an unlatching position with prop 78*a* swung out from under the intermediate latch pin, as seen in phantom in FIG. 8. When this occurs, the free end of the intermediate latch drops to the extent permitted by stop pin 94, permitting primary latch assembly 60 to be rotated under the urgence of mechanism springs 32 in the clockwise direction to the extent necessary to slide primary latch 34 off of cradle shoulder 20*a*, as seen in FIG. 9. Cradle 20 is then released to be swung in the clockwise direction about its pivot pin 21 as the mechanism springs discharge. When the line of action of the mechanism springs passes to the left of the upper toggle link pin 25, as seen in FIG. 1, the toggle is collapsed to the left, propelling the movable contact assemblies to their tripped open position seen in FIG. 2 as the mechanism springs discharge.

As will be described, before the movable contact assemblies reach their tripped open position, the trip latch assembly begins resetting itself. Significantly, resetting of the trip latch assembly begins before prop 54 in FIG. 3 is disengaged from bell crank assembly 40 to permit any charge stored in charging spring 46 to be expended in returning cradle 20 to its reset position. That is, secondary latch 74 is released from its unlatching position of FIG. 7 before prop 54 is removed. Spring 76 is then free to pivot secondary latch 74 in the clockwise direction seen in FIG. 10. The sloping, leading edge 74*d* of prop 74*a* engages latch pin 93 to cam the free end of intermediate latch 90 upwardly. Before the charging spring can restore the cradle to its reset position, prop 74*a* is swung clockwise into its latching position beneath latch pin 93, and primary latch assembly 60 is restored to its latching position. As the cradle approaches its reset position, its leading edge 20*d* kicks latch 34 out of the way without otherwise disturbing the primary latch assembly, as seen in FIG. 11. As the cradle moves beyond its reset position, spring 70 restores latch 34 to its latching position in intercepting relation with cradle shoulder 20*a*. By virtue of the low mass of latch 34, restoration thereof by spring 70 to its latching position after the cradle shoulder goes by is achieved very quickly. When reset roller 41 of bell crank assembly 40 (FIGS. 2 through 4) disengages the cradle to conclude its counterclockwise, resetting swing motivated by charging spring 46, mechanism springs 32 (FIG. 1) take over to propel the cradle in the opposite, clockwise direction. This motion is arrested when cradle shoulder 20*a* engages latch 34. The considerable impact force created by this engagement is readily absorbed by the trip latch assembly and ultimately by prop 74*a*. By virtue of the force attenuating effect of intermediate latch 90, the force absorbed by this prop is of a greatly reduced magnitude. Moreover, as previously noted, this attenuated force does not exert any significant moment on secondary latch 74, and consequently the possibility of this secondary latch "shocking out" and thus precipitating spurious unlatching of the cradle is eliminated. It will also be noted that successful relatching of the cradle in its reset position is not dependent on swift restoration of the trip initiating secondary latch 78. When this secondary latch is restored by its return spring 81, its prop 78*a* freely assumes its latching position beneath the reduced diameter portion 93*a* of the latch pin ready to assume latch control over the cradle when secondary latch 74 is removed upon subsequent closure of the breaker contacts.

Figure 13:
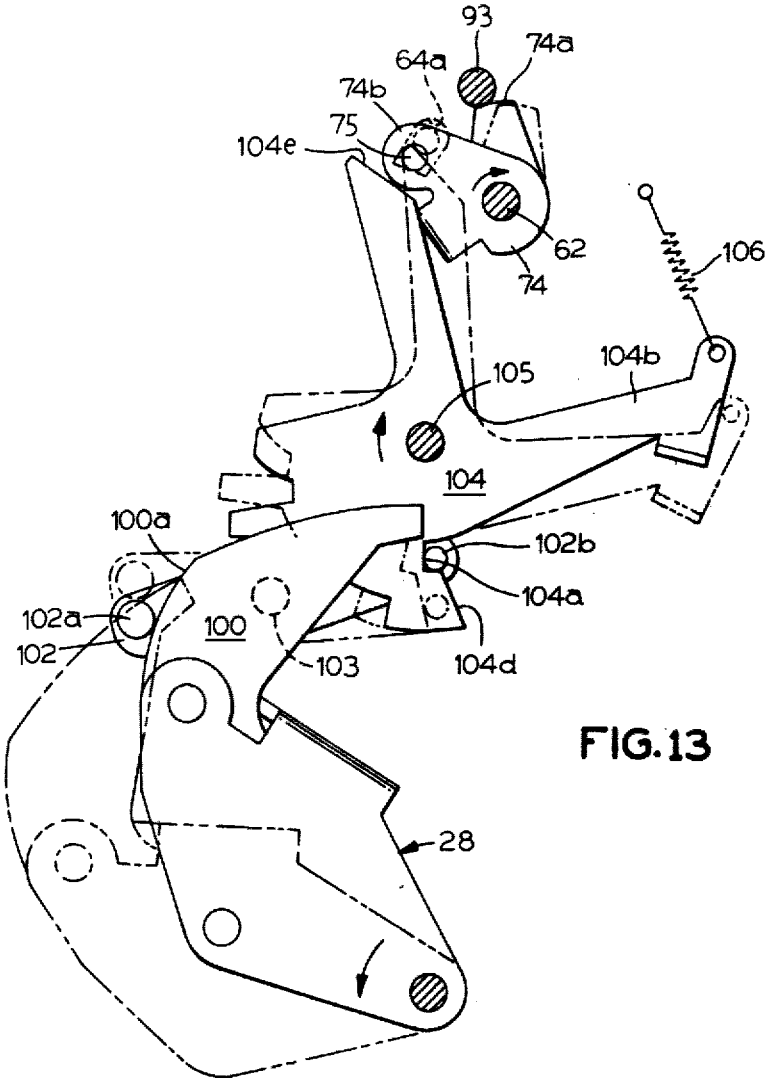
FIG. 13 is a simplified, side elevational view of the hook apparatus of FIG. 12, illustrating its release of the breaker movable contacts from their hooked open position.

To contend with the high impact forces incident with stopping the movable contact assemblies 28 in their hooked open position of FIG. 1 as they spring from their tripped open position of FIG. 2 toward their closed circuit position while mechanism springs 32 are charged, a more elaborate hook arrangement than the simple hook 38 was necessitated. To this end, as seen in FIGS. 12 and 13, a cam plate 100, presenting an elongated, compound arcuate cam edge 100*a*, is mounted by the center pole movable contact assembly. This cam edge engages a roller pin 102*a* carried at the left end of an intermediate hook lever 102 which is pivotally mounted intermediate its ends on a pin 103 mounted by one of the mechanism frame sideplates 22. The other end of this intermediate hook lever carries a latch pin 102*b* which is latchably received in a notch 104*a* provided in a primary hooklever 104 which is pivotally mounted by a hub 105 (FIG. 13); this pivotal mounting being preserved by a screw 105*a* (FIG. 12). This primary hook lever includes a generally horizontally extending actuating arm 104*b* and an upstanding actuating finger 104*c*. A tension spring 106 biases the primary hook lever to a counterclockwise-most hooking position with latch pin 102*b* of the intermediate hook lever lodged in notch 104*a*.

FIG. 12 depicts the movable contact assemblies in their tripped open position assumed when mechanism springs 32 (FIG. 1) are completely discharged. Under these circumstances, cam edge 100*a* is disengaged from roller pin 102*a* of intermediate latch lever 102. When, during the return of cradle 20 from its tripped position by the discharge of charging spring 46 (FIG. 4) pursuant to charging mechanism springs 32, the line of action of the mechanism springs moves to the right of toggle pivot pin 26 (FIG. 1) and the mechanism springs become empowered to straighten the toggle. The movable contact assemblies are thus abruptly propelled from their tripped open position toward their closed circuit position. This closing movement is arrested at the hooked open position when cam edge 100*a* impacts with roller pin 102*a* of intermediate hook lever 102. Since latch pin 102*b* is lodged in primary hook notch 104*a*, the clockwise movement exerted on the intermediate hook lever by the charging mechanism springs is resisted, and the movable contact assemblies are readily arrested in their hooked open position, seen in solid line in FIG. 13, while the cradle is being re-latched in its reset position.

To now unhook the movable contact assemblies for closure under the urgence of the fully charged mechanism springs, primary hook 104 is simply pivoted from its latching position in the clockwise direction to its unlatching position seen in phantom line in FIG. 13. This pivotal movement, which may be induced by a closing solenoid (not shown) acting on primary hook actuating arm 104*b*, disengages latch pin 102*b* from notch 104*a*. The clockwise pivotal restraint on intermediate hook 102 is thus removed, thereby unhooking the movable contact assemblies for movement to their closed circuit position under the urgence of the charged mechanism springs 32. During this closure movement, cam 100 propels intermediate hook 102 through an increment of clockwise rotation to an unhooking position. In this process, latch pin 102*b* acts on a sloping edge 104*d* of primary hook 104 beneath notch 102*a* to propel the primary hook through an increment of clockwise pivotal movement in addition to and independent of the closure initiating action on the primary hook in initially dislodging latch pin 102*b* from notch 104*a*. During this additional increment of clockwise primary hook pivotal movement to an extreme unlatching position induced solely by the closing movement of the movable contact assemblies, the upper edge 104*e* of primary hook finger 104*c* picks up pin 75 carried by secondary latch 74 (FIGS. 5 through 7, 12 and 13). This secondary latch is thus rotated in the clockwise direction seen in FIG. 13 (counterclockwise in FIGS. 6 and 7) to swing its prop 74*a* out from under intermediate latch pin 93 of the trip latch assembly.

As was noted in the description of the trip latch assembly in conjunction with FIGS. 5 through 11, secondary latch 74 is pivoted from its latching position to its unlatching position incident with the closure of the breaker contacts. It is now seen that this operation is achieved with primary hook 104 acting in response to closure movement of the movable contact assemblies communicated thereto by cam 100 and intermediate hook 102. Preferably, the geometry of primary hook 104 is such that secondary latch pin 75 is not picked up until latch pin 102*b* is irretrievably dislodged from notch 104*a*. Thus, secondary latch 74 cannot be removed by the externally induced pivotal movement of the primary hook to initiate unhooking of the movable contact assemblies, but only when the movable contact assemblies are committed to closure. This precludes so-called "crashing" of the breaker operating mechanism while the movable contact assemblies are in their hooked open position by the spurious removal of both secondary latches 74 and 78 of the trip latch assembly.

Figure 10:
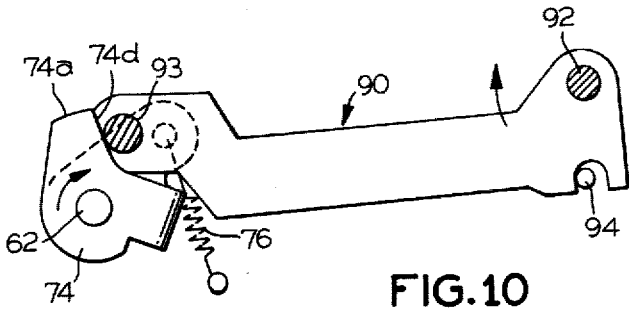
FIG. 10 is a fragmentary, side elevational view of the trip latch assembly of FIG. 5 illustrating its latch resetting action.

While the movable contact assemblies remain in their closed circuit position, cam 100 maintains intermediate hook 102 and primary hook 104 in their phantom line positions of FIG. 13, and secondary latch 74 is thus held in its phantom line removed or unlatched position. Secondary latch 78 is thus armed to initiate tripping of the breaker as described in conjunction with FIG. 8. When the breaker is tripped, the movable contact assemblies spring to their trip open position where cam 100 releases intermediate hook 102, as seen in FIG. 12. Spring 106 is then free to pivot primary hook 104 in the counterclockwise direction back to its latching position. In the process, edge 104*d* thereof, acting on latch pin 102*b*, cams intermediate hook 102 in the counterclockwise direction to a hooking position where the latch pin is re-engaged in notch 104*a*. At the same time, primary hook finger 104*c* is displaced from pin 75, freeing spring 76 to restore secondary latch 74 to its latching position and, in the process, to reset the trip latch assembly (FIG. 10). From FIG. 2, it will be recalled that prop 54 is not removed to initiate recharging of the mechanism springs 32 (FIG. 1) until the movable contact assemblies substantially achieved their tripped open position. Consequently, the resettings of the trip latch and the primary and intermediate hooks are effected essentially before recharging of the mechanism springs begins.

As detailed in the above-noted related application entitled Circuit Breaker Hook Apparatus, trip lever 82 may be pivoted in the clockwise direction of FIG. 12 herein by, for example, depression of a cover-mounted pushbutton. An edge portion 82*d* of the trip lever leg 82*a* picks up pin 80 to remove secondary latch 78 and trip the circuit breaker (FIG. 8 herein). It is noted that trip lever 82 is completely divorced from secondary latch 74 and thus can not impede the trip latch assembly reset action of this secondary latch. Consequently, even if the trip lever sustains the removal of the breaker trip initiating secondary latch 78, the trip latch assembly is nevertheless reset and thus capable of sustaining a recharge imparted to the operating mechanism by the charging mechanism when the movable contacts spring to their hooked open position.

Secondary latch defeat lever 86 is utilized to interface the trip latch assembly with accessory trip apparatus, such as disclosed in the above-noted related application entitled Unvervoltage Release Reset and Lockout Apparatus. As disclosed therein, an accessory trip function is effected by picking up pin 220 to induce clockwise pivotal movement of the defeat lever, as seen in FIG. 12 herein. This motion picks up pin 80 to remove secondary latch 78, thereby tripping the breaker. Defeat lever 86 also picks up pin 75 to remove secondary latch 74 and discharge the operating mechanism if an accessory trip function is called for while the movable contacts are held in their hooked open position. This is done to prevent closure of the breaker into, for example, a prevailing undervoltage condition in response to the movable contacts being released from their hooked open position. By discharging the operating mechanism before the movable contacts are unhooked, they are precluded from moving in the closing direction, but rather are propelled directly to their tripped open position.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A trip latch assembly for releaseably latching the cradle of a circuit breaker operating mechanism in a reset position, said trip latch assembly including, in combination:

A. an elongated primary latch pivotally mounted intermediate its ends;

B. a primary latch element pivotally mounted to said primary latch adjacent one end thereof;

C. a latch spring biasing said latch element to a latching position engageable with a cradle latching shoulder to sustain the cradle in its reset position against the force of a charged breaker operating mechanism spring exerting a moment on said primary latch;

D. a first secondary latch pivotally mounted for movement to a latching position in response to opening of the breaker and to an unlatching position in response to closure of the breaker;

E. a second secondary latch pivotally mounted for movement between latching and unlatching positions;

F. an elongated intermediate latch pivotally mounted adjacent one end;

G. an intermediate latch element mounted adjacent the other end of said intermediate latch in a position of common engagement with the other end of said primary latch and either said first secondary latch in its latching position while the breaker is open or said second secondary latch in its latching position while the breaker is closed, the geometry of the engagements of said primary and secondary latches with said intermediate latch element, coupled with the elongation of said intermediate latch, being effective in significantly attenuating the force of the charged breaker operating mechanism spring ultimately absorbed by said secondary latches, (1) whereby, upon movement of said second secondary latch to its unlatching position in disengaged relation with said intermediate latch element, said primary latch is freed to pivot from a latching position to an unlatching position where said primary latch element is swung away from engaging relation with the cradle shoulder and the cradle is propelled to its tripped position as the operating mechanism spring discharges to open the breaker.

2. The trip latch assembly defined in claim 1, wherein said intermediate latch element is in the form of a latch pin, and said first secondary latch includes a first prop having a latch pin engaging edge radiused about the pivotal mounting axis of said first secondary latch.

3. The trip latch assembly defined in claim 2, wherein second secondary latch includes a second prop having a latch pin engaging edge radiused about a center offset from the pivotal mounting axis of said second secondary latch, whereby the force of the charged operating mechanism spring on said second prop exerts a moment on said second secondary latch in the direction of its unlatching position, and a return spring opposing this moment to normally retain said second secondary latch in its latching position.

4. The trip latch assembly defined in claim 3, wherein said first and second props and said latch pin are structured such that, with both said first and second secondary latches in their latching positions, said latch pin is engaged by said first prop and said second prop is in closely spaced, disengaged relation with said latch pin.

5. The trip latch assembly defined in claim 3, wherein said primary latch includes a latch pin engaging surface arranged such that the force of the charged operating mechanism spring exerted on said primary latch creates a moment on said intermediate latch having a first moment arm, said intermediate latch moment exerting a force on said props of said secondary latches via a second moment arm corresponding to the distance between said latch pin and the pivotal mounting axis of said intermediate latch, said second moment arm having a considerably greater length than said first moment arm, whereby to significantly attenuate the charged operating mechanism spring force absorbed by said props.

6. The trip latch assembly defined in claim 2, which further includes a reset spring biasing said first secondary latch to its latching position incident with opening of the circuit breaker, and said first prop including a camming edge portion engaging said latch pin, incident with the return of said first secondary latch to its latching position, to angularly position said intermediate latch such as to restore the common engagement of said latch pin with said primary latch and said first secondary latch prop and thereby reset said primary latch to its latching position with said primary latch element disposed in its latching position well in advance of the return of said cradle to its reset position from its tripped position, said latch spring yielding as said primary latch element is momentarily displaced from its latching position to accommodate the cradle's return to its reset position without disturbing the primary latch in its latching position.

7. The trip latch assembly as defined in claim 6, in combination with hook means operable to releaseably hold the breaker movable contacts in a hooked open position against the force of the charged breaker operating mechanism spring attempting to drive the movable contacts to their closed position, upon release of the movable contacts from their hooked open position by said hook means, the closing movement thereof actuating said hook means to pivot said first secondary latch from its latching position to its unlatching position where it is held by said hook means while the breaker is closed.

8. The trip latch assembly defined in claim 6, which further includes a trip member selectively operable to pivot said second secondary latch from its latching position to its unlatching position, thereby tripping the circuit breaker, said trip member having no effect on the positioning of said first secondary latch.

9. The trip latch assembly defined in claim 8, which further includes a secondary latch defeat member selectively operable to jointly pivot said first and second secondary latches from their respective latching positions to their respective unlatching positions, whereby to prevent the trip latch assembly from latching the cradle in its reset position.

10. The trip latch assembly defined in claim 9, wherein said primary latch, said first and second secondary latches, said trip member and said secondary latch defeat member are pivotally mounted on a common shaft.

* * * * *